United States Patent [19]

Maruta et al.

[11] Patent Number: 4,831,414

[45] Date of Patent: May 16, 1989

[54] COPYING APPARATUS CAPABLE OF COPYING A DOCUMENT WITH BINDING MARGIN

[75] Inventors: Syuzi Maruta, Toyokawa; Masazumi Ito, Toyohashi; Tadashi Ohira, Toyokawa, all of Japan

[73] Assignee: Minolta Camera Kabushiki Kaisha, Osaka, Japan

[21] Appl. No.: 8,342

[22] Filed: Jan. 29, 1987

[30] Foreign Application Priority Data

Jan. 29, 1986 [JP] Japan ..... 61-017404

[51] Int. Cl.[4] ..... G03G 21/00

[52] U.S. Cl. ..... 355/219; 355/313

[58] Field of Search ..... 355/3 R, 3 SH, 14 R, 355/14 SH, 23, 24

[56] References Cited

U.S. PATENT DOCUMENTS 4,090,787 5/1978 Hubbard et al. ..... 355/14 R
4,162,844 7/1979 Traister et al. ..... 355/24 X
4,187,024 2/1980 Satomi et al. ..... 355/14 R
4,218,128 8/1980 Satomi et al. ..... 355/24 X
4,272,180 6/1981 Satomi et al. ..... 355/14 SH X
4,537,497 8/1985 Masuda ..... 355/24 X

*Primary Examiner*—Fred L. Braun
*Attorney, Agent, or Firm*—Price, Gess & Ubell

[57] ABSTRACT

A copying apparatus of the present invention is capable of executing, for example, a duplex-simplex copy mode wherein images on both sides of an original are respectively copied on one side of a different copy paper and a simplex-simplex copy mode wherein an original with an image on one side is copied to one side of a single copy paper. The copying apparatus is further capable of executing a shift mode for controlling the relative position between the images on the original and those on the copy paper if the original represents a binding margin in the duplex-simplex copy mode. This shift mode is released when the simplex-simplex copy mode is selected.

15 Claims, 8 Drawing Sheets

COPYING APPARATUS CAPABLE OF COPYING A DOCUMENT WITH BINDING MARGIN

BACKGROUND OF THE INVENTION

This invention relates to improvements in and relating to copying apparatuses. More specifically, it is concerned with copying apparatuses, wherein means are provided for designating any selected one of a number of copy-making modes upon execution with a document's image capable of being shifted when each copying job is completed.

It should be mentioned at this stage of description that the term "duplex" to be used throughout the present specification and appended claims denotes such a copying possibility for reproducing front and rear pages of each original document. Further, this term can be used for copy-making upon front and rear pages of each copy paper when applicable.

Well known are such duplex copying apparatuses that are capable of executing copying jobs on front and rear pages of each copy and in several different copy modes.

Generally speaking, for execution of a duplex copying job with the use of an original document carrying image information on the both pages thereof and on the above type copier machine, the original is reversed in its position from front to rear page under the action of an original-position reverser means upon completion of a regular copying job on the front page image information. Then, the reversed original is reset on the transparent platen of the copier for execution of a next succeeding copying job based upon the rear page image information of the original, and so on.

When it is desired to execute copying jobs successively on both pages of an original document which may be of the duplex type as was described above, or otherwise, of the simplex type original which represents image information exclusively on the front page, the rear page thereof being thus blank, one-page serviced copy paper is once stored in an intermediate tray or magazine for preparatory storing, and then refed to a position as a next succeeding step.

First to fourth copy modes are employed generally in the operation of the above kind of known copier machines.

The first copy mode represents the duplex-duplex copy mode adapted for execution of duo-page copying service on each copy paper, with use of duo-page documents as the original, each representing image information on the both pages thereof, in one page-to-one page relationship between the original and the copy paper, and so on.

The second copy mode represents the duplex-simplex copy mode adapted for execution of a single page copying service on successively fed copy papers, with use of duo-page documents as the original, each representing image information on the both pages thereof, in one page to one page relationship between the original and the copy papers, and so on.

The third copy mode represents the simplex duplex copy mode adapted for execution of duo-page copying service on copy paper, with use of single imaged page document as the original, in one page to one page relationship between documents and copy paper, and so on.

The fourth copy mode represents the simplex-simplex copy mode adapted for execution of single page copying service on copy papers, with use of single imaged page documents as the original, in one page to one page relationship between the original and the copy paper.

It will be clearly understood from the foregoing description that there are provided in such copier machines, copy mode designation means adapted for making a selection at the will of the operator, of any one of the foregoing four kinds of copy modes, as occasion may desire.

When using the above kind of copiers and with the use of original documents, each representing a binding margin along one side edge thereof, and further, when the second or the third copy mode has been designated, it is naturally necessary to align all the formed binding margins on copied papers at a specifically preselected paper edge.

As an example, when the second copy mode has been predesignated, the front surface of a duo-paged original is at first brought into contact with the transparent document table of the copier and then a copying service is brought about on one page of a first copy paper for copy-making. Upon completion of this copying job executed on the front page of the copy paper, the original document is reversed up-and-down under the action of conventional document-reversing means and then, the now appearing rear page of the thus reversed document is brought into contact position with said transparent document table, resulting in, however, that the binding margin of the rear page shifting naturally to the opposite side. Therefore, if the next succeeding copying step should be carried into effect with the presently set original document, the binding margin appearing on a second copy paper will be positioned equally at the opposite side thereof, which creates a problem For resolving such a problem, improved copiers fitted with such means as capable of aligning binding margins throughout a number of successive photocopying services even with the use of duo-paged original documents of the above kind, have already been proposed in U.S. Pat. Nos. 4,187,024 and 4,272,180, as preferred examples.

In a preferred embodiment of these improved copiers, the exposure-scanning timing is subjected to an adjustment for alternating one after another the copying operation when each rear page of a series of duo-paged documents are being copied. Or alternatively, a corresponding timing for feeding copy papers is properly adjusted or controlled.

With the use of such timing-adjusted copiers another drawback has been encountered, when single-paged original documents are provided with respective binding blank margins and are copied successively on single pages of copy papers, or otherwise, when duo-paged documents with respective idle margins are used for copying on both pages of copy papers, an alternating disalignment of the copied margins throughout a number of copy papers will result.

SUMMARY OF THE INVENTION

It is, therefore, an object of the present invention to provide an improved photocopier capable of removal of the aforementioned conventional drawbacks and operable in several different copy modes for producing defect-free photo-copies.

Another object is to provide such an improvement of a photo-copier which is provided with means for adjusting a relative position of a binding-margined original document and to-be-copied images thereon, as capable of preventing production of defective copies even if a failure of a necessary resetting of the adjusting means should have occurred by error or maloperation.

These and further objects of the invention can be fulfilled by providing an improved photo-copier comprising a first copy mode designation means adapted for designating a first copy mode to use both sides of each of a number of duo-paged document pages as the original and to perform successive copying jobs on duo-pages of each of a number of copy papers; and/or second copy mode designation means adapted for designating a second copy mode to use single-imaged pages of a number of documents as the original and to perform successive copying jobs on single pages of each of a number of copy papers; control means for controlling the relative position between the images on the original document and those on the copy paper if the original represents a binding margin; and means for releasing the control means from its operating position, upon designation of either the first or second copy mode.

These and other objects, advantages and features of the inventionn will become more apparent from the following description thereof taken in conjunction with the accompanying drawings whicn illustrate a specific embodiment of the invention.

BRIEF DESCRIPTION OF THE DRAWINGS

In the following description, like parts are designated by like reference numerals throughout the several drawings.

PREFERRED EMBODIMENT OF THE INVENTION

Figure 1:
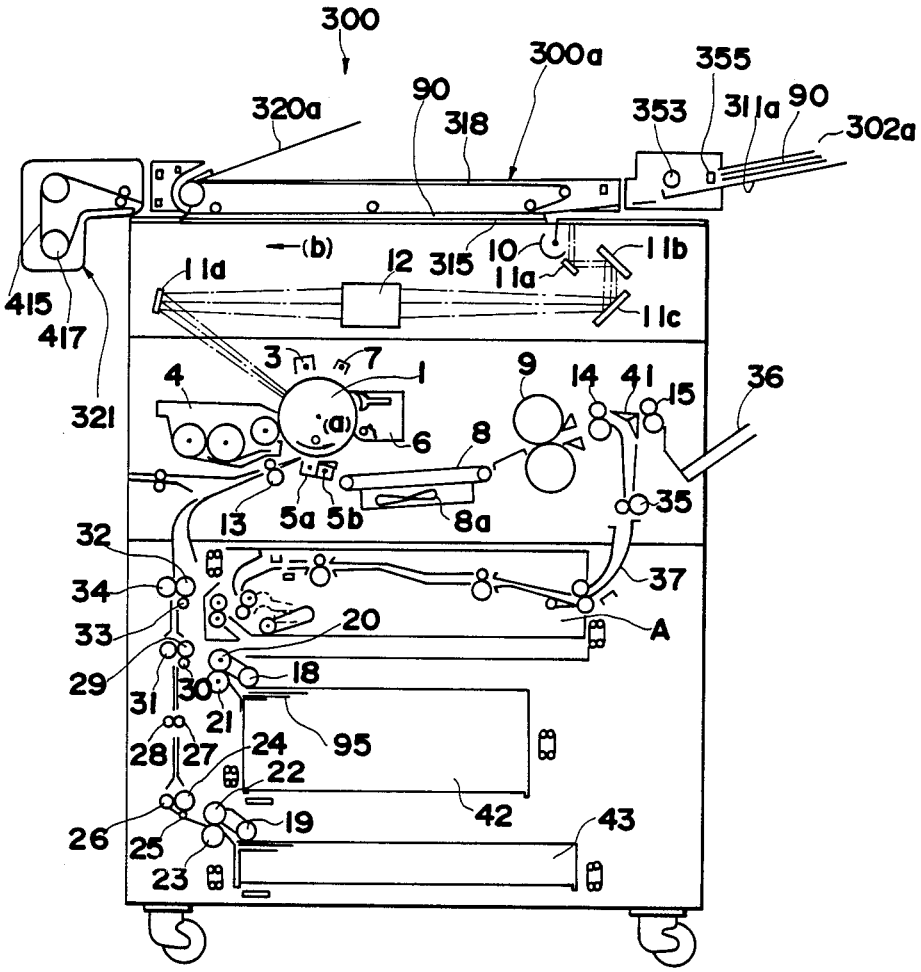
FIG. 1 is a schematic elevational section of a preferred embodiment of the inventive copier.

In FIG. 1 schematically illustrating a preferred embodiment of a copying machine according to the present invention, numeral 1 represents a conventional photosensitive drum arranged at a substantially middle height thereof and mounted rotatably in the direction shown by a small arrow (a).

A main charger 3; a developer unit 4; a transfer charger 5*a*; a separating charger 5*b*; a cleaner unit 6 and an eraser unit 7 are arranged in succession as such and around the drum 1 as shown, all these units being of conventional design.

In operation, the surface of photosensitive drum 1 is uniformly and evenly charged and then subjected to exposure of an optical image to form an electrostatic image thereon, as conventionally. This latent image will be then developed under the action of developer unit 4 and transferred onto a copy paper by transfer charger 5*a*, as is commonly known to any person skilled in the art.

An optical system which is arranged below a document support table 315 to scan the image of the document comprises a light source 10; a set of movable mirrors 11*a*–11*c*; a projector lens 12 and a fixed mirror 11*d*, which are arranged relatively as shown. Light source 10 and movable mirror 11*a* are capable of moving jointly in such direction as shown by a small arrow (b) at a speed defined by a formula of V/m, when assuming that V represents the peripheral speed of photosensitive drum 1 which is always constant regardless of intentional variation in magnification factor m of the copied image, or briefly "copying magnification". Movable mirrors 11*b* and 11*c* can translate jointly in the direction as shown by a small arrow (b), and at a speed as defined by V/2m.

Paper magazines 42; 43 are provided at lower levels one above another in the interior space of the machine and copy papers are stored therein, as conventionally. These magazines are mounted on each pair of rails and may be pulled out through the doored front side of the machine and pushed back slidingly or rollingly thereinto, as conventional, although not specifically shown and described on account of its very popularity.

Copy papers stored in the first magazine 42 and those stored in the second magazine 43 are fed out therefrom selectively and once per sheet by forced rotation of either paper feed roller 18 or 19, respectively, upon subjected to a sheetwise loosening job under the action of loosening rollers 20; 21; 22 and 23 and then conveyed to timing roller pair 13 through carrier rollers 29; 30; 31; 24; 25; 26; 32; 34; 27 and 28 when generally denoted. Each copy paper thus fed out is held once stationary directly before said timing roller pair 13 and then fed to a transfer section, and indeed, in synchronism with the image formed on the sensitive drum 2; subjected to transfer of the tonered image by the discharge action at transfer charger 5*a*; and separated from the drum surface upon being subject to the discharge at separation charger 5*b*. The thus copied and separated paper is further conveyed by conveyer belt 8 fitted with air suction means 8*a* to a depositing unit 9 for being subjected therein to a fusing deposition of the tonered image.

In the downstream proximity of the outlet of the depositing unit 9, there are provided carrier roller pair 14 and discharge roller pair 15 and further a route change lever 41 arranged therebetween.

When the copied and deposited paper is to be discharged as per se, the lever 41 is so operated as to discharge the paper onto a tray 36.

If, however, the paper is to be subjected to a duo-page copying job or otherwise a composite copying job, the lever 41 is so manipulated that the paper change its conveying route from roller pair 14 through 35 and along guide plate 37 to intermediate tray unit "A" to be described later.

On the other hand, upon execution of the transfer job, the drum 1 has removed occasionally residual toner under the action of a conventional cleaner unit 6 and then, is subjected to optical projection from eraser lamp 7 for removal of residual electrical charge, for the preparation of a next succeeding copying cycle.

It will be noted from the foregoing that the intermediate tray "A" receives and stores single page copied papers for refeeding them sheetwise for completion of duo-page copying or complex copying jobs.

The automatic document feeder (ADF) generally comprises a document table unit 302*a* for supplying stacked documents 90 one by one; a document feed unit 300*a* for feeding the supplied document 90 to the prescribed exposure position by a feed roller 353 and for discharging the document therefrom and a document reversing unit 321 for reversing the document fed from the document feed unit 300*a* and feeding it back for copying the other side of the document.

The document table unit 302*a* includes a document supporting table 311*a* and a sensor or a switch 355 for detecting the presence of the document on the table 311*a*. The document feed unit 300*a* disposed on the document support table 315 includes a document transporting belt 318 rotatably supported by a plurality of rollers. The transporting belt 318 transports the document onto the prescribed exposure position at which time the belt is stopped and after making a desired number of copies, the belt 318 is driven to discharge the document either to a discharge tray 320*a* or to the document reversing unit 321. The document reversing unit 321 includes a belt 415 for reversing the document and a motor 417 for driving the belt 415. When the document is fed to the reversing unit 321, the document is further transported by a plurality of rollers to which a belt is suspended. The document is reversed in its side by going through a U-turn path for the transportation back to the document support table 315. In this way, images on both sides of the document are copied.

Figure 2:
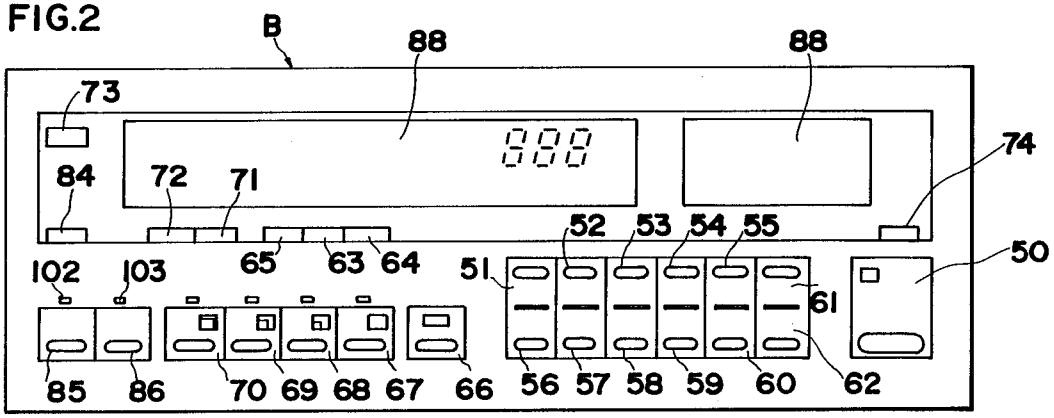
FIG. 2 is a schematic plan view of a controller adapted for controlling several main components of the inventive copier.
Figure 3:
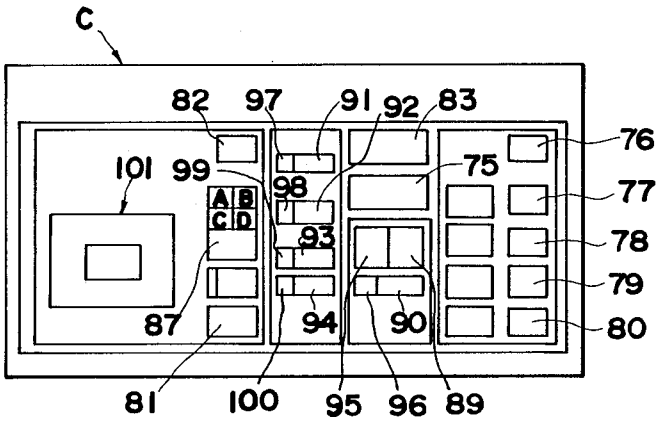
FIG. 3 is a schematic plan view of a first operation panel employed in the embodiment.

In FIG. 2, a first operation panel B is shown, and in FIG. 3, a second operation panel C is illustrated. In the practical machine, the second operation panel is arranged at the left hand side of the first operation panel, when seen in FIG. 2.

As schematically shown, the first and second operation panels comprise the following operation keys:

50: print button for initiation of copying service.
51–60:ten keys for presetting of the desired sheet number.
61: interruption key for execution of interruption copy job.
62: a double-service key, capable for acting as stop key for stopping multi-copying service and as clearing key for clearing once preset copying paper sheet number.
63: key for preselection and release of automatic exposure service.
64: exposure down key in manual exposure service.
65: exposure up key in manual exposure service.
66: paper feed opening selection key.
67–70:copy magnification selection keys unable in 1:1 magnification, fixed two stage reducing services and fixed one stage magnifying service.
71: magnification factor up key for elevating stepwise the copy size magnification factor.
72: magnification factor down key for reducing stepwise the copy size magnification factor.
73: total check key for reading out preset total copy sheet number.
74: all reset key for returning the copy mode to the initial state.
75: anamo-copy mode selection key.
76: zoom magnification factor input key.

Operation panel c is provided with following several display LEDs:

95: binding margin copy mode selection display.
96: shift mode selection display.
97: composition copy mode selection display.
98: Book-copying, duplex copy mode selection display.
99: Book-copying, divisional copy mode selection display.
100: duplex-simplex copy mode selection display.
101: designated region display in case of editorial copy mode.
102: simplex-duplex copy mode selection display.
103: duplex-duplex copy mode selection display.

Next, function and operation in each of specifically selected-out copy modes will be described in more detail.

(a) Binding margin copy mode

In case of the execution of the binding margin copy mode, each copied paper is formed with a binding margin along the right hand edge thereof. Even if the used original document should represent not enough blank space, thus being fully occupied by images, the copied paper can effectively and advantageously be formed with such binding margin in accordance with the present copy mode principles. The product copies are thus easily bindable together.

(b) Anamo-copy mode

In case of the anamo-copy mode, the widthwise range of copy is kept at a constant value which depends upon the lens position, while the lengthwise image range is either shortened or lengthened as desired by controlling the scanning speed only. It should be noted, however, when the polarized anamo-magnification factor (aspect ratio) is selected to be beyond such range, preferably as between 95 and 105%, the resulted image resolution would become worse beyond practical usage. In such a case an alarm display will be brought about for showing the condition to the user.

If it is desired to produce clear and stabilized copy products, it is enough to a arrange specifically designed lens means at the optical passage way.

(c) Book copy mode

In case of the book copy mode is specifically adopted, the copy service for two neighboring open pages can be successfully and successively copied by depressing a single print button.

(d) Copy modes d-1: duplex-duplex copy mode

According to this mode, key 86 is depressed for selecting-out the duplex-duplex copying job to make copies of both pages of the document on the both pages of the copy paper.

d-2: Simplex-duplex copy mode

For making photo-copies of two single paged documents on both pages of a single copy paper, depression of key 85 is enough to realize such a copy mode operation.

d-3: Duplex-simplex copy mode

Respective page-images of a duplex type original document are copied successively on one page of a single copy paper. Selection of this mode can be made by depressing key 94.

(e) Shift mode

This mode is adopted in such case. In one case, copies of simplex documents are made on both pages of copy papers, or, in another case, duplex paged images of a document are copied on single pages of copy papers. As an example, duo-paged images of a single original document having respective binding margins are photocopied on single pages of two copy papers. In this case, when no specific means are provided, a second copied paper will represent a binding margin with an oppositely shifted position.

For this reason, when the shift mode operation has been selected a document image will be copied with alternative positional shifting, sheet per sheet, in successive copying jobs, each, a these shifts being adjusted by such an amount equal to the binding margin size. Generally speaking, therefore, all the binding margins of product copies thus provided are in precise registration when viewed in the thickness direction of the stack of copied papers.

It should be noted, however, that the shift mode even though once selected out will be inhibited from service, if either duplex-duplex copy mode or normal copy mode that is the simplex-simplex copying operation has been specified. In a similar way when either the duplex-duplex copy mode or the normal copy mode has been specified, the shift mode operation will be released. The reason is that when the shift mode operation is selected, even though either a duplex-duplex copy mode or normal copy mode is in service, surplus formation of binding margins and/or a irregular formation of binding margins may be frequently and disadvantageously encountered.

In this case, the exposure-scanning timing or corresponding timing for feeding copy papers is adjusted or controlled in every other copying operation for aligning all the formed binding margins on copied papers when the shift mode is selected.

(f) Editorial copy mode

When a trimming or conversely a masking of a specifically selected local section or sections of the image of a document is desired, the editorial copy mode is selected.

Figure 4:
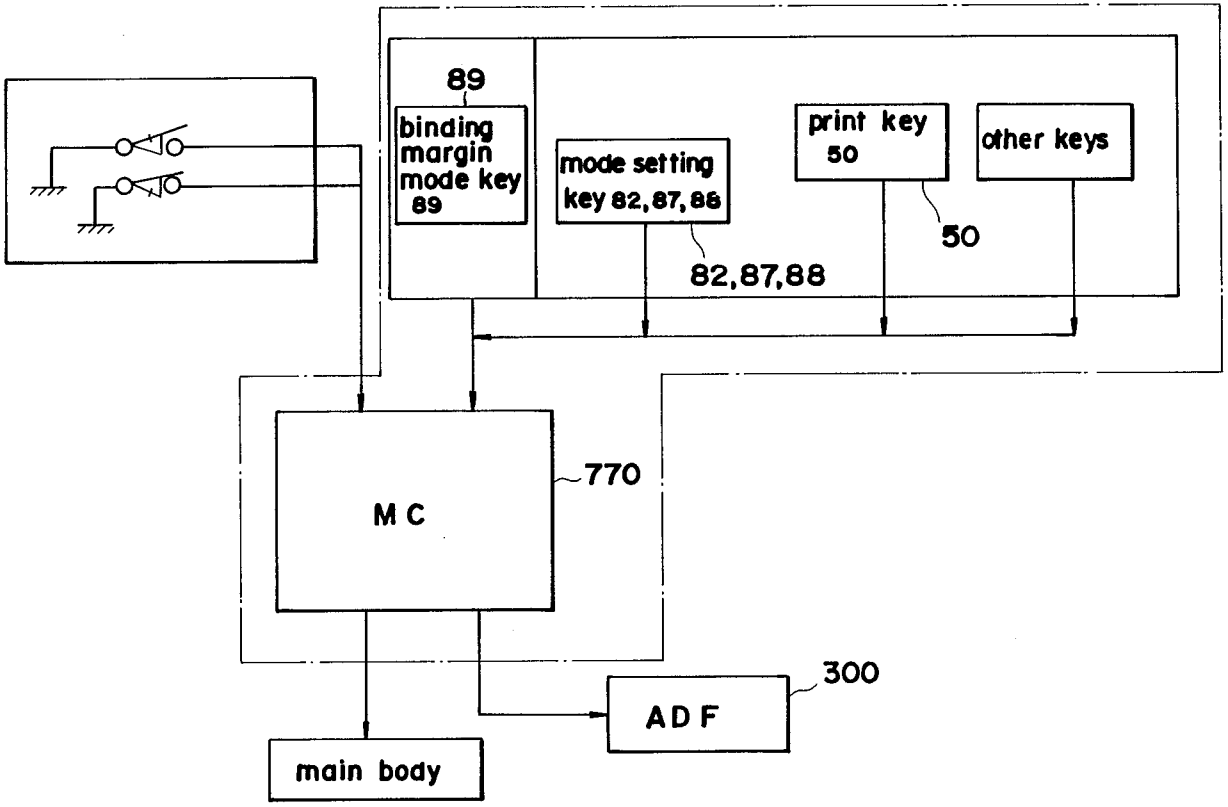
FIG. 4 is a schematic arrangement view of a second operation panel employed.

The operational control of all the foregoing operational modes is carried into effect via a microprocessor adapted for control of the copier machine proper, as shown in FIG. 4.

FIG. 4 shows a microcomputer 770 and its related circuitry for control of the operation of the present copier machine. The microcomputer 770 is connected with print key 50; several keys 85, 86 and 94 adapted for setting respective copy modes; binding margin formation key 89 and several further key means. The microcomputer controls the operation of the copier machine proper and ADF depending upon the respective operational setting of each working mode, as may be more fully described hereinbelow.

In the following, with reference of the flow chart shown, operational control modes to the microcomputer 770 will be explained.

Figure 5:
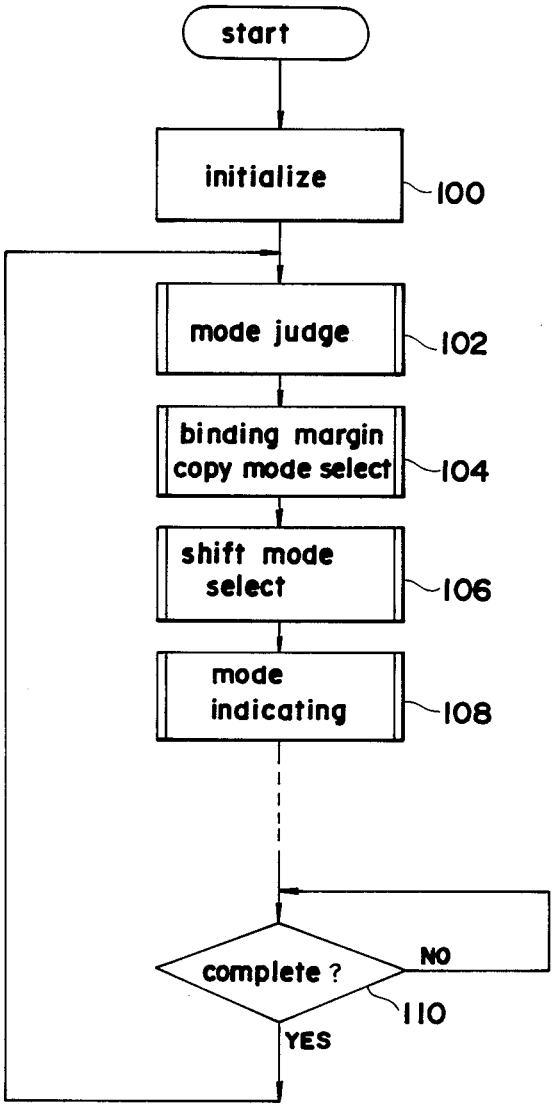
FIG. 5 is a flow chart of main routine of the control program for controlling main operations of the inventive copier.

In FIG. 5, a flow chart is shown of the main routine to be executed by the microcomputer 770. When the program starts, at 100, the state is initialized to clear a RAM and a preset register and the like and the machine is subjected to an initial setting, and computer 770 causes inside timer means contained to energize for starting a counting job. This counting is to measure the time to be consumed for execution of one routine.

Then, computer 770 performs several subroutines from step 102 to step 108 and programs, not shown and described, concerning the copying jobs. If, at step 110, the measured and counted time, started at step 100, is adjusted to be longer than the prescribed one, the routine jumps to step 102, and a repeated operation from step 102 to step 110 is performed.

At step 102, computer 770 performs as, the first subroutine, a copy mode selection discriminating job, and step 104, it executes a binding margin copy mode selection discriminating job as the second subroutine.

At step 106, the computer executes as the third subroutine a shift mode selection discriminating job, and at step 108, it discrimates as the fourth subroutine how the copy modes and the shift mode have been preset.

Now referring to FIG. 6 to FIG. 9, how the computer operates at these subroutines will be set forth more in detail.

Figure 6:
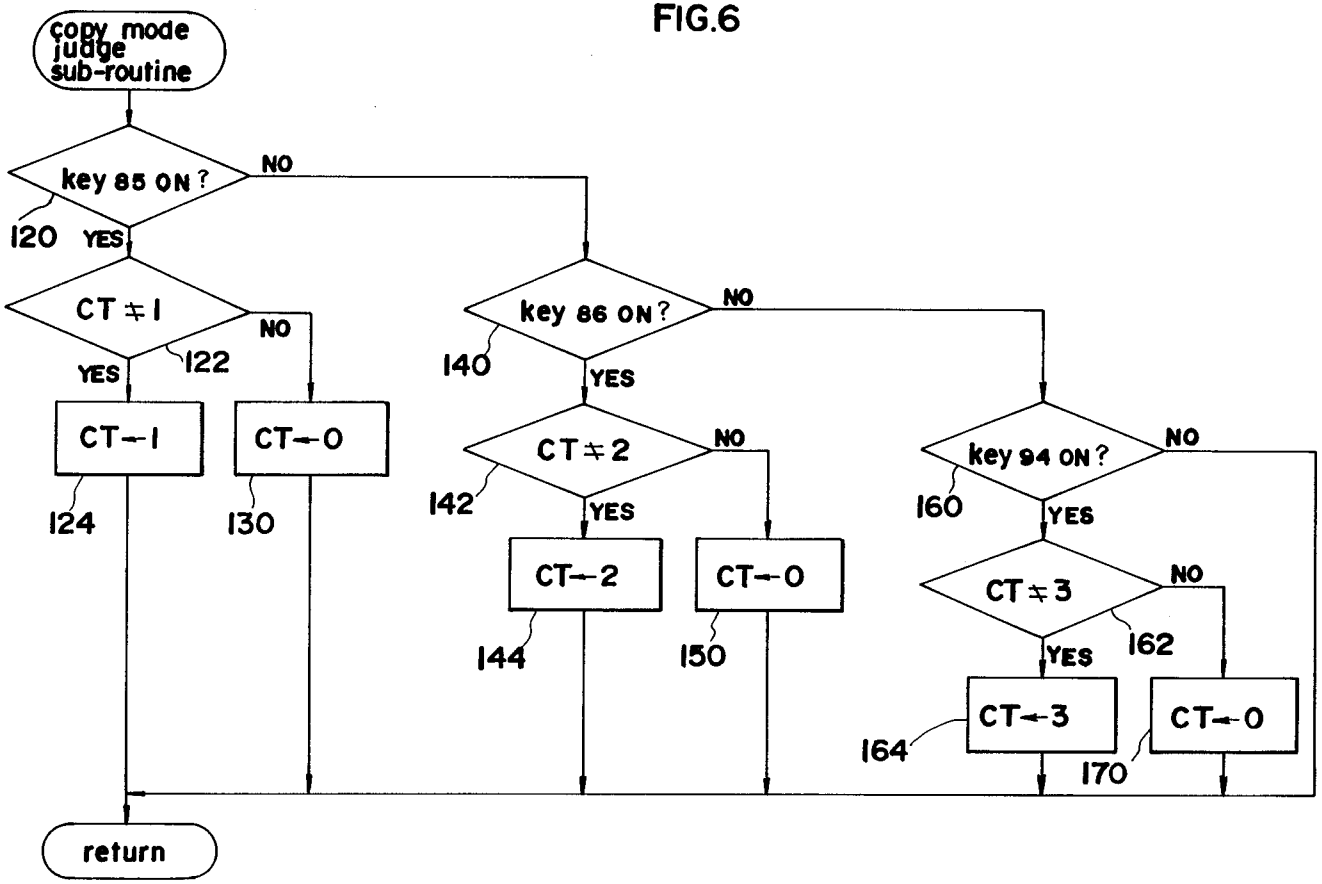
FIG. 6 is a flow chart of sub-routine for discrimination of copy mode.

With reference to FIG. 6, when a call is made from a main routine of the first or copy mode selection subroutine, the computer 770 initiates its operation from step 120.

Step 120, step 140 and step 160 denote those procedures for discriminating if a simplex-duplex copy mode, duplex-duplex copy mode or duplex-simplex copy mode has been preselected or not.

At step 120, key 85 is discriminated to be in an ON or OFF condition. At steps 140 and 160, keys 86 and 94 are discriminated as respectively ON or not. Upon execution of these discriminating jobs, then CT-parameter values for setting copy modes are respectively discriminated. When the practical respective values are not in coincidence with CT=1; CT=2 and CT=3, these values 1;2 and 3 being preset for discrimination of respective modes, i.e. these values are set to CT=1; CT=2 and CT=3. If these measured values are CT=1; CT=2 and CT=3, respectively, a setting CT=0 is made at each of these steps. Whereupon, the computer 770 executes further the main program.

More specifically and as an example, when it is adjudged at step 120 that the key 85 serving for instructing to make copies of a simplex mode original document onto the both pages of a copy paper has been depressed to a set position, the computer 770 shifts in operation to the next succeeding step 122 for discriminating the present CT-value. When it is adjudged that the CT-value is not 1, parameter CT at the next step 124 is set at 1 for showing that the key 85 has been operated. However, if CT-value is adjudged to be 1, CT is set to 0 at the next step 130. Similar discrimination and CT-setting jobs will be executed at steps 140 to 150; steps 160 to 170 and with relation to keys 86 and 94, respectively.

Figure 7:
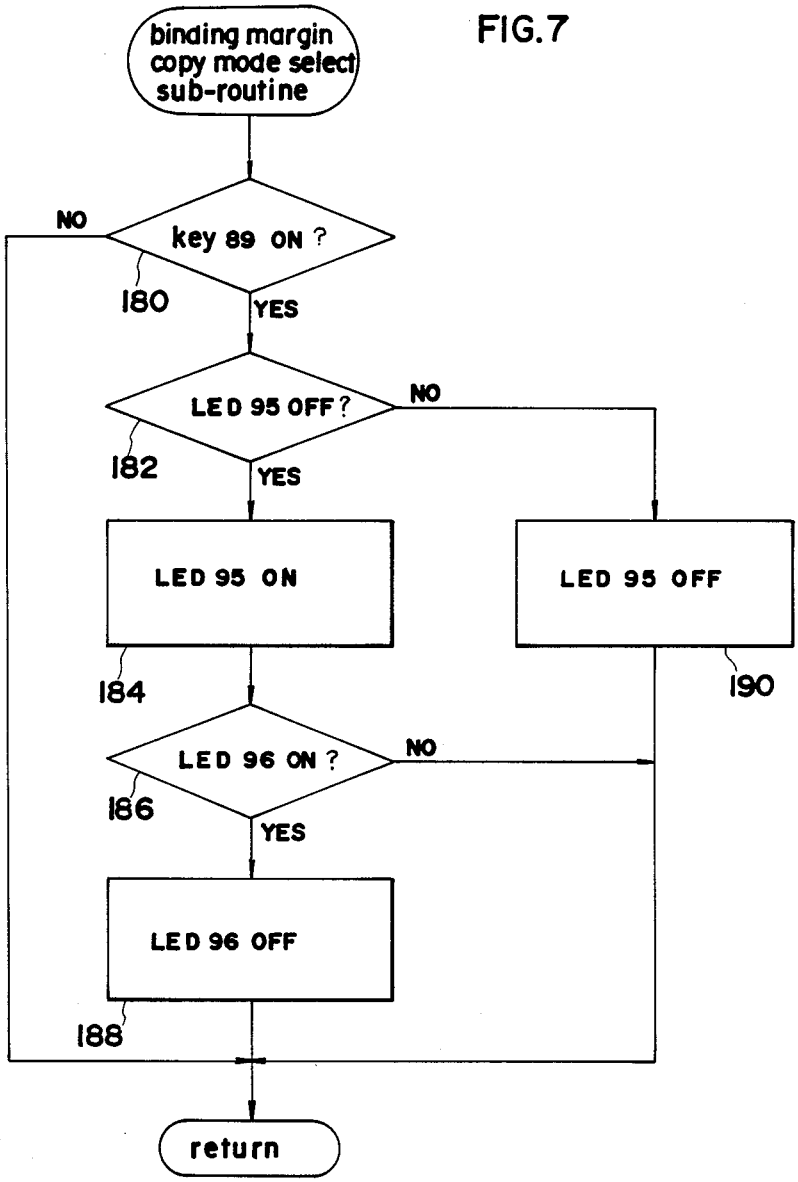
FIG. 7 is a flow chart of a sub-routine for discrimination of set position of binding margin shift button employed.

Further, referring to FIG. 7, a second subroutine adapted for discriminating if the binding margin copy mode has been selected or not, will be set forth more in detail.

When this subroutine has been called for, computor 770 initiates an operation by starting from step 180.

This second subroutine serves for discriminating if the binding margin copy mode key 89 has been operated or not and for displaying the fact if the key has been brought to its operated position. More specifically at the step 180, it is discriminated if the binding margin copy mode key 89 has been operated upon or not, and when it has not yet been brought to an operated position, a return is made back to the main program. When the key 89 is adjudged to have been operated, the routine job will be shifted to step 182 for discriminating if the related display lamp 95 is extinguished or not. Depending upon this discrimination, respective control signals are delivered at the steps 184 and 190 for igniting and extinguishing the binding margin copy mode display LED 95. With delivery of such control signal for extinguishing the LED 95, the routine job will be returned back to the main program per se. With delivery of such a control signal for igniting the LED 95 at step 184, however, it is acknowledged at steps 186 and 188, if the shift mode display LED 96 is not ignited. If, however, the LED 96 is igniting, a control signal will be delivered to extinguish the LED 96 and only thereafter, the routine job is returned back to the main program per se.

Figure 8:
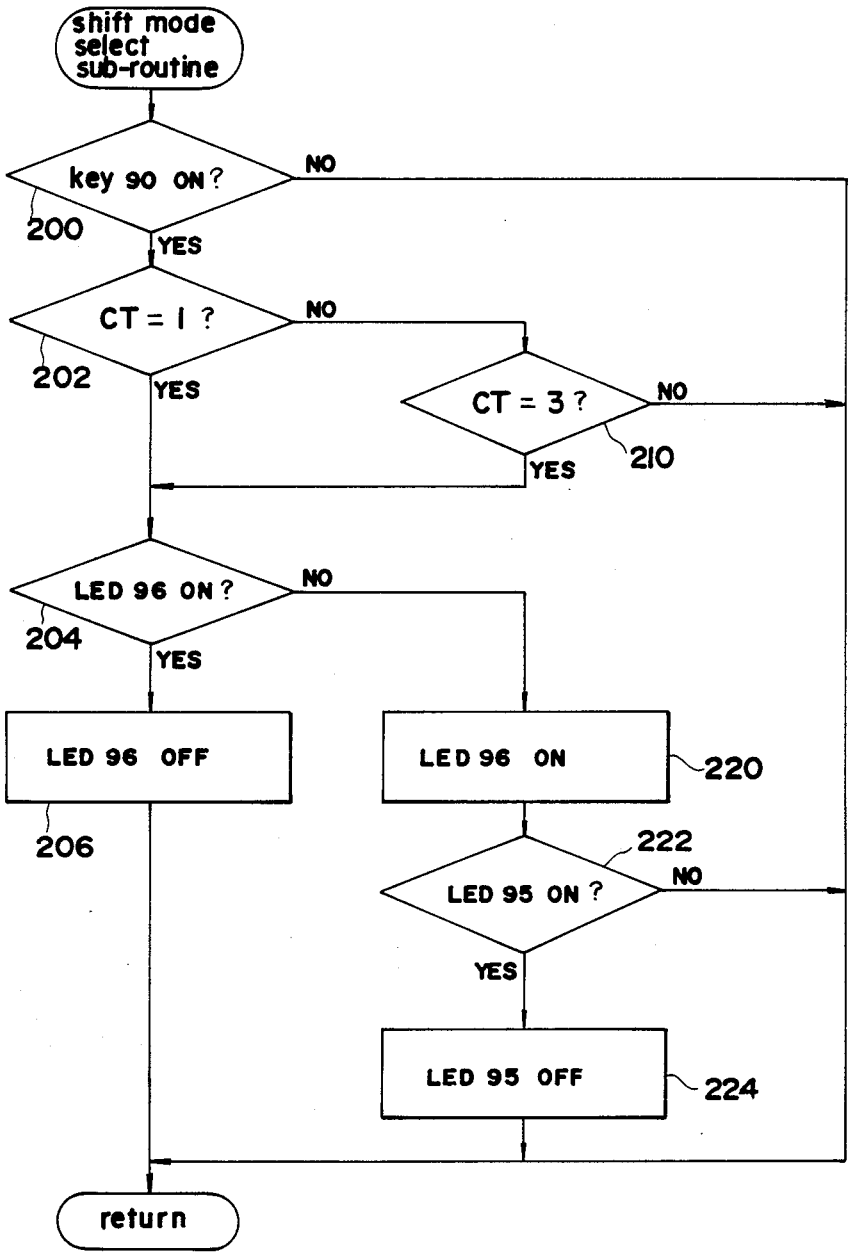
FIG. 8 is a flow chart of sub-routine for discrimination of set position of single page shift button employed.

Further, referring to FIG. 8, the third subroutine adapted for discriminating if the shift mode has been selected out or not will be set forth more in detail. If this subroutine is called for, computor 770 will execute an operation by starting from step 200.

In case of the third subroutine, it is discriminated if shift mode key 90 has been operated upon or not, and if the shift key has been operated, the fact will be shown by a corresponding display.

More specifically at step 200, it is discriminated if shift key 90 has been operated upon or not, and when not operated, the routine job will be returned back to the main program per se. When the key 90 has been brought to the operated position, the processing job will shift to step 202. At steps 202 and 210, how the copy mode has been preset is determined by consulting with the presently appearing value of parameter CT. When it is discriminated at step 202, that copies should be produced from two single page original documents on duo-pages of a single sheet copy paper, the fact is displayed and then, the routine job will be shifted to step 204.

On the other hand, when it is discriminated at step 210, that a duplex original document is used for simplex copy-making on single pages of two copy papers, the thus adjudged fact is displayed, and only thereupon, the routine job is shifted to step 204.

With "YES" at steps 202 and 210, the processing is advanced to step 204, for discriminating if by shift mode LED 96 is igniting or not. With the LED 96 igniting, it is extinguished at stage 206 and the processing job will be returned back. On the contrary, if LED 96 is kept extinguished, it is caused to ignite at step 220. At step 222, it is discriminated if a binding margin copy mode LED 95 is igniting or not. When igniting, the LED 95 is caused to extinguish at step 224, and only then, an operational return will be invited, and so on.

Figure 9:
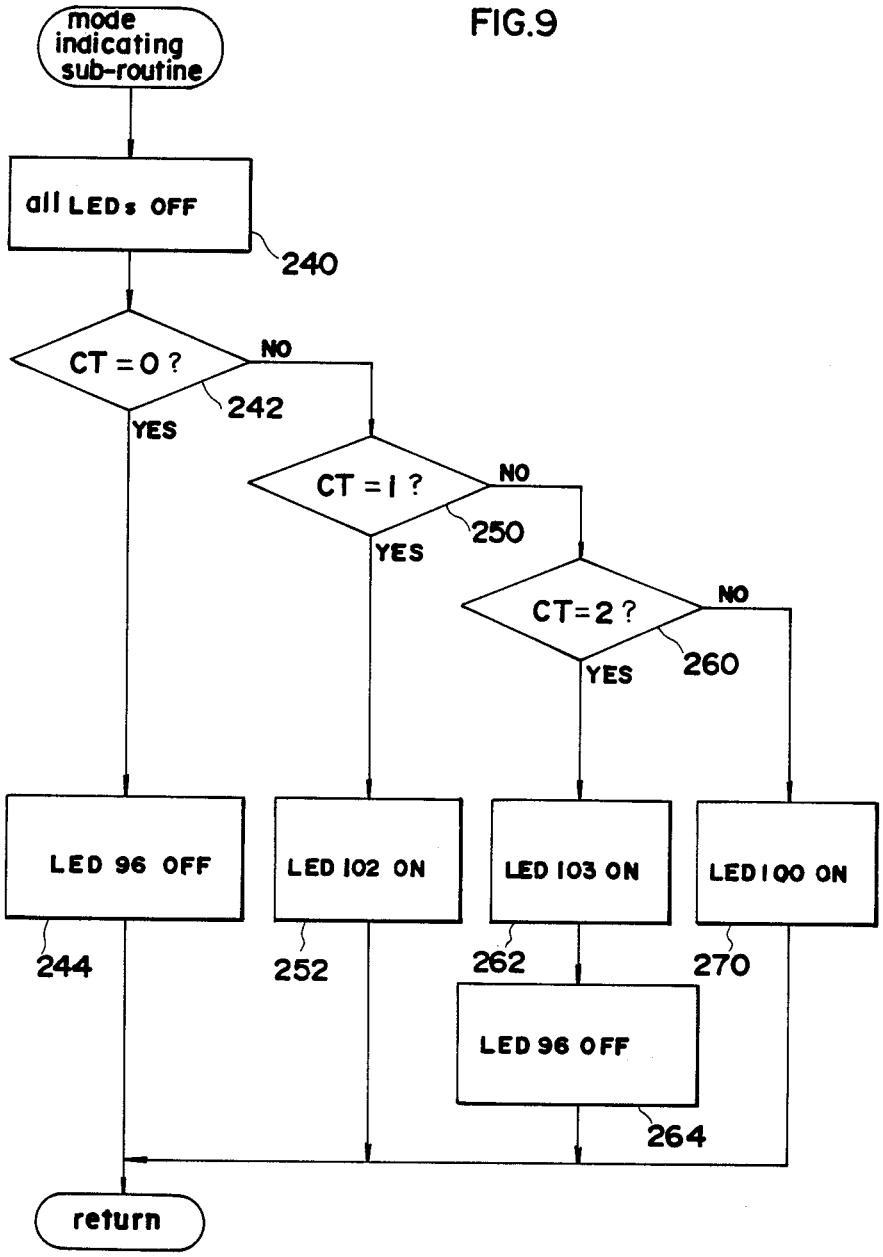
FIG. 9 is a flow chart of sub-routine for showing set position of copying modes and setting of a binding margin.

The fourth subroutine will be set forth with reference to FIG. 9, as a last stage of description. In fact, this fourth subroutine constitutes a main feature of the present invention. When this subroutine is called for, computer 770 will start to operate by starting from step 240.

If a copy-making job is executed with reliance of indications displayed herein, otherwise produced unacceptable copies can be effectively avoided.

In this subroutine, at first, all LEDs for displaying each copy mode, that is, simplex-duplex copy mode selection display 102, duplex-duplex copy mode selection display 103 and duplex-simplex copy mode selection display 100 are extinguished at step 240. Thereafter, steps 242, 250 and 260 respectively discriminate the value of parameter CT. According to the result of the discrimination, the LED 96 for displaying the designation of the shift mode is extinguished at steps 244 and 264. More specifically, when the simplex-simplex copy mode is adjudged to be selected at step 242, the LED 96 is extinguished, and when step 260 discriminates the designation of duplex-duplex copy mode, the LED 96 is also extinguished.

These facts show that the shift mode is released in the simplex-simplex or duplex-duplex copy mode.

For better understanding of the invention, such an assumption may well be considered that in ease of the present embodiment, the user should try to make a true reproduction of a duplex mode of an orignial document representing, however, a reasonable binding margin on each page thereof. Then, the user may select a proper shift mode for the realization of optimal margin registration through both pages of the scheduled true copy. Then, he will adopt the duplex-simplex copy mode, by which, for producing simplex copies on two copy papers and from the both pages of the original. Then, print key is depressed for execution of copying jobs. In this case, naturally, defectless and well-acceptable copies will be produced in the scheduled regular way.

Then, it is further assumed that the user wants to make a copying job with the use of both pages of a single copy paper and based upon the same image information of the same original, wherein, indeed, the copied pages represent true and correct binding margins, respectively. In the case of the present invention, the foregoingly adopted shift mode is released with adoption of the last mentioned setting.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In a copying apparatus having a shift mode designation assembly for changing a positional relationship between a leading edge of an image to be copied and that of a copy paper at every other copying operation, said assembly being operational in a simplex-duplex copying mode and a duplex-simplex copying mode, the improvement comprising:

control means for releasing a previously designated shift mode, said releasing automatically occurring upon a user selecting one of a simplex-simplex copying mode and a duplex-duplex copying mode such that said changing of the positional relationship is eliminated in said simplex-simplex copying mode and said duplex-duplex copying mode.

2. The improvement according to claim 1 wherein said control means is actuated without a resetting of said shift mode designation assembly.

3. The improvement according to claim 1 wherein said control means allows said shift mode designation assembly to remain operational during said duplex-simplex copying mode and said simplex-duplex copying mode.

4. A copying apparatus capable of making a duplex copy comprising:

feeding means for forming images on the copy paper fed by said feeding means, said image forming means being capable of changing a positional relation between the leading edge of images and that of copy paper;

shift mode designating means for designating a shift mode wherein the positional relation between the leading edge of the image to be copied and that of copy paper changes at every other copying operation, and control means for automatically releasing or inhibiting the shift mode when copy images to be reproduced is identical in the form of the original to be copied.

5. A copying apparatus comprising:

feeding means for feeding copy paper, one by one;

image forming means for forming images on the copy paper fed by said feeding means, said image forming means being capable of changing a positional relationship between the leading edge of images and that of the copy paper;

a first mode designating means for designating a first mode wherein an original with an image on one side is copied on one side of a copy paper;

a second mode designating means for designating a second mode wherein a first image on one side of an original and a second image on the other side of said original are respectively copied onto different copy paper;

shift mode designating means for designating a shift mode wherein the positional relationship between the leading edge of the image to be copied and that of the copy paper changes at every other copying operation; and control means for releasing said shift mode designated by said shift mode designating means in response to the designation of said first mode.

6. A copying apparatus comprising:

feeding means for feeding copy paper, one by one;

image forming means for forming images on the copy paper fed by said feeding means, said image forming means being capable of changing a positional relationship between the leading edge of images and that of the copy paper;

a first mode designating means for designating a first copy mode wherein an original with images on both sides is copied on both sides of a single copy paper;

a second mode designating means for designating a second copy mode wherein an original with an image on one side is copied on one side of a copy paper;

a third mode designating means for designating a third copy mode wherein a first image on one side of an original and a second image on the other side of said original are respectively copied onto different copy paper;

shift mode designating means for designating a shift mode wherein the positional relationship between the leading edge of the image to be copied and that of the copy paper changes at every other copying operation for controlling the relative position between the images on an original and those produced on a copy paper, and control means for releasing said shift mode, after having designated said first or second copy mode.

7. A copying apparatus as claimed in claim 6, further comprises a fourth copy mode designating means for designating a fourth copy mode wherein respective images on one side of two different originals are copied to both sides of a single copy paper.

8. A copying apparatus as claimed in claim 6 wherein said shift mode changes the positional relationship between the leading edge of the image to be copied and that of copy paper by adjusting the exposure-scanning timing.

9. A copying apparatus as claimed in claim 6 wherein said shift mode changes the positional relationship between the leading edge of the image to be copied and that of copy paper by controlling the corresponding timing for feeding copy paper.

10. A copying apparatus comprising:

feeding means for feeding copy paper, one by one;

image forming means for forming images on the copy paper, fed by said feeding means, said image forming means being capable of changing a positional relationship between the leading edge of images and that of the copy paper;

a first mode designating means for designating a first copy mode wherein an original with images on both sides is copied to both sides of a single copy paper;

a second mode designating means for designating a second copy mode wherein an original with an image on one side is copied to one side of a copy paper;

a third mode designating means for designating a third copy mode wherein a first image on one side of an original and a second image on the other side of said original are respectively copied to two different pieces of copy paper;

a fourth mode designating means for designating a fourth copy mode wherein respective images on one side of two different originals are copied to both sides of a single copy paper;

shift mode designating means for designating a shift mode wherein the positional relationship between the leading edge of the image to be copied and that of the copy paper changes in a predetermined amount at every other copying operation for controlling the relative position between the images on an original and those on a copy paper; and control means for inhibiting the designation of said shift mode when said first or second copy mode is designated.

11. A copying apparatus comprising:

feeding means for feeding copy paper one by one;

image forming means for forming images on the copy paper fed by said feeding means, said image forming means being capable of changing a positional relation between the leading edge of images and that of copy paper;

a first mode designating means for designating a first mode wherein an original with an image on one side is copied to a copy paper in its one side;

a second mode designating means for designating a second mode wherein a first image on one side of an original and a second image on the other side of said original are respectively copied to a different copy paper;

shift mode designating means for designating a shift mode wherein the positional relation between the leading edge of the image to be copied and that of copy paper changes at every other copying operation, and control means for inhibiting the designation of said shift mode when the first mode has been designated.

12. A copying apparatus comprising:

feeding means for feeding copy paper one by one;

image forming means for forming images on the copy paper fed by said feeding means, said image forming means being capable of changing a positional relation between the leading edges of images and that of copy paper;

a first mode designating means for designating a first copy mode wherein an original with images on both sides is copied to both sides of a single copy paper;

a second mode disignating means for designating a second copy mode wherein an original with an image on one side is copied to a copy paper in its one side;

a third mode designating means for designating a third copy mode wherein a first image on one side of an original and a second image on the other side of said original are respectively copied to a different copy paper;

shift mode designating means for designating a shift mode wherein the positional relation between the leading edge of the image to be copied and that of copy paper changes at every other copying operation for controlling the relative position between the images on an original and those on a copy paper and control means, when having already designated the first or second copy mode by said first or second copy mode designating means, for inhibiting the designation of said shift mode.

13. A copying apparatus as claimed in claim 12 further comprises a fourth copy mode designating means for designating a fourth copy mode wherein respective images on one side of a different original are copied to both sides of a single copy paper.

14. A copying apparatus as claimed in claim 12 wherein said shift mode changes the positional relation between the leading edge of the image to be copied and that of copy paper by adjusting the exposure-scanning timing.

15. A copying apparatus as claimed in claim 12 wherein said shift mode changes the positional relation between the leading edge of the image to be copied and that of copy paper by controlling the corresponding timing for feeding copy paper.

* * * * *